US006646211B2

(12) United States Patent
Taniuchi et al.

(10) Patent No.: US 6,646,211 B2
(45) Date of Patent: Nov. 11, 2003

(54) SWITCH

(75) Inventors: Ryoichi Taniuchi, Fukui (JP); Takeshi Fujii, Fukui (JP); Toyoshi Fukumura, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 3 days.

(21) Appl. No.: 10/224,278

(22) Filed: Aug. 21, 2002

(65) Prior Publication Data

US 2003/0038020 A1 Feb. 27, 2003

(30) Foreign Application Priority Data

Aug. 24, 2001 (JP) ..... 2001-254319

(51) Int. Cl.[7] ..... H01H 9/00
(52) U.S. Cl. ..... 200/4; 200/18
(58) Field of Search ..... 200/5 R, 339, 200/6 A, 4, 18, 341–345

(56) References Cited

U.S. PATENT DOCUMENTS 3,928,743 A * 12/1975 Ohashi ..... 200/308
4,203,017 A * 5/1980 Lee ..... 200/244
4,314,111 A * 2/1982 Kobayashi ..... 200/4
4,861,950 A * 8/1989 Yanai et al. ..... 200/5 R
5,934,453 A * 8/1999 Sugawara et al. ..... 200/339
6,162,999 A * 12/2000 Ishikawa et al. ..... 200/339
6,388,221 B1 * 5/2002 Rudolph et al. ..... 200/339

FOREIGN PATENT DOCUMENTS

JP 62-53538 * 4/1987
JP 62-53539 * 4/1987

* cited by examiner

*Primary Examiner*—Elvin Enad
*Assistant Examiner*—M. Fishman
(74) *Attorney, Agent, or Firm*—Wenderoth, Lind & Ponack, L.L.P.

(57) ABSTRACT

A switch having good maneuverability includes a switch case, a rocker-button unit having a hole therein and a rotating shaft located at a side of the rocker button unit and held at the switch case, and a push-button unit movably disposed in the hole. Further, the switch includes a slider whose upper surface comes in contact with a lower surface of the push-button unit, and the slider is movably accommodated in the switch case.

21 Claims, 5 Drawing Sheets

SWITCH

FIELD OF THE INVENTION

The present invention relates to a switch, which is incorporated in a dashboard and the like of a car, that changes the operation of electric devices of the car.

BACKGROUND OF THE INVENTION

Conventional switches, which are incorporated in a dashboard and the like of a car, correspond to electric devices of the car. FIG. 10 is a partial front view of the dashboard using the conventional switches, and shows ON-OFF switch 1 for a windshield wiper and push switch 2 for ejecting cleaning fluid.

ON-OFF switch 1 is a rocker switch for switching from a neutral position to a right or a left position. For example, in FIG. 10, when switch 1 is switched to the right position, the windshield wiper is operated slowly, and when switch 1 is switched to the left position, the windshield wiper is operated quickly.

When switch 2 is pushed, the cleaning fluid is ejected, and when switch 2 is released, switch 2 returns to an original position mechanically and ejecting of the cleaning fluid stops.

FIG. 10 shows a part of the dashboard, but an actual dashboard has many switches, e.g., switches for controlling an air-conditioning in the car, locking and unlocking a door key of the car or operating information devices.

The conventional switches incorporated in the dashboard correspond to electric devices of the car, and recent cars have various electric devices, so that many switches are incorporated in the dashboard. As a result, it is difficult for drivers to operate the many switches correctly and promptly.

A switch unifying a pushing switch and a rocker switch is disclosed in utility model laid-open No. S62-53538 and No. S62-53539 to solve the problems discussed above. However, the conventional switches disclosed above cannot provide enough click-feeling, and especially, the click-feeling deteriorates after repeated operations.

SUMMARY OF THE INVENTION

The present invention addresses the problems discussed above, and aims to provide a switch that can be simply incorporated in a dashboard and can be promptly operated. Because the switch has good maneuverability, the switch can prevent an erroneous operation by a driver.

The switch of present invention includes the following elements:

(a) a switch case, (b) a rocker-button unit having a perforation thereon and a rotating shaft, which is located at a side of the rocker button unit and held at the switch case, (c) a push-button unit inserted at the perforation movably and vertically, and (d) a slider whose upper surface comes in contact with a lower surface of the push-button unit, the slider accommodated in the switch case movably and vertically.

This structure can provide the small switch having functions of a rocker switch and a push-button switch, so that an area for incorporating the switch becomes small.

DETAILED DESCRIPTION OF PREFERRED EMBODIMENT

Figure 1:
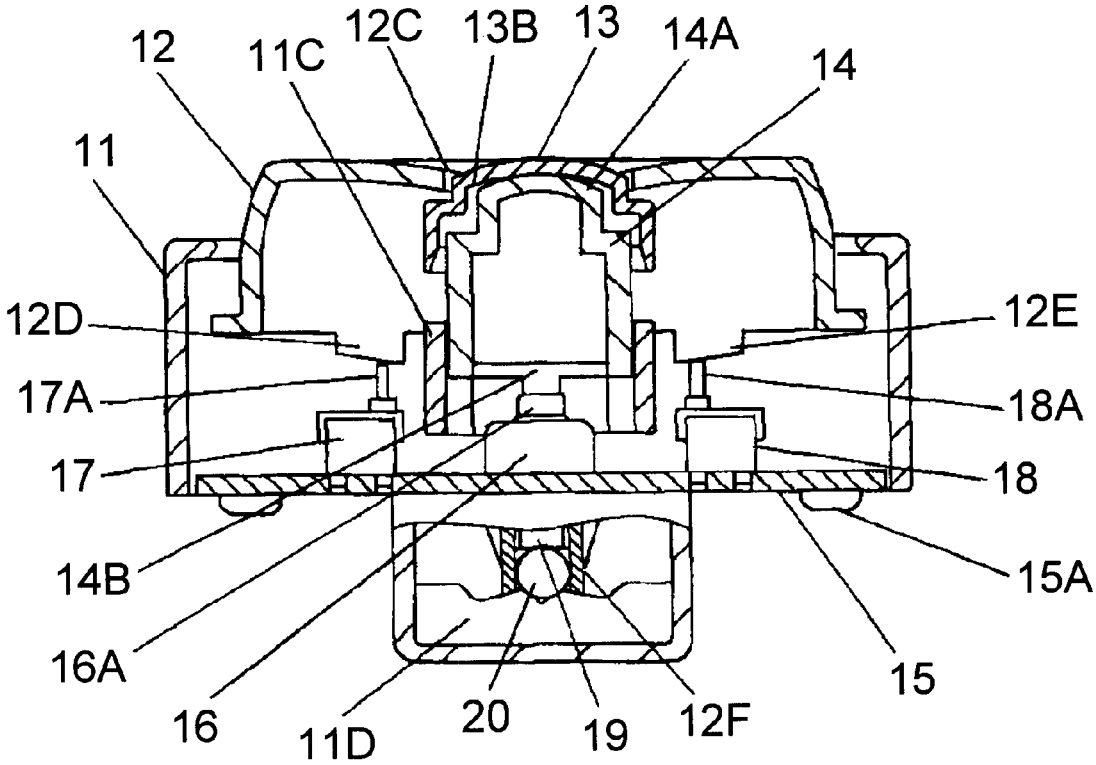
FIG. 1 shows a sectional view of a switch in accordance with a first exemplary embodiment of the present invention.

A switch of this invention has a perforation on an operating surface of a rocker-button unit, where the perforation is perpendicular to the operating surface, and a push-button unit is inserted at the perforation and is vertically movable. The switch is formed by unifying the rocker-button unit and a push button unit, thereby having functions of a rocker switch and a push button switch. Therefore, the switch can be small and an area for incorporating the switch can be small. As a result, the switch can be simply incorporated in a dashboard, prevent an erroneous operation by a driver and be promptly operated because the switch has good maneuverability.

The push-button unit of this invention has a dome shape, and has horizontal protrusions on its edge, where the protrusions are used for preventing rotation of the push-button unit by touching a guide section of the rocker-button unit. These- horizontal protrusions can prevent rotation resulted from repeated operations of the push-button unit or vibration of a car, and prevent deterioration of visibility of a display of the push-button unit.

An upper surface of the rocker-button unit protrudes from an opening of an upper surface of a box-shaped switch case, and the rocker-button unit is held at a side of the switch case rotatably by using rotating shafts located at its sides. A bottom part of the push-button unit comes in contact with an upper part of a slider, which is held in a middle part of the switch case and is movable vertically. Protrusions of a bottom part of the rocker-button unit and a bottom part of a slider come in contact with switch units for operating, where the switch units are disposed on a substrate and under an opening of the switch case.

The switch has a click feeling element which retains a position after operation of the rocker-button unit. The click feeling element is formed of the following elements:

a) protrusions of a bottom part of the rocker-button unit, b) a bottom part of the switch case, and c) an elastic member and a head, whose lower surface is arc shaped, located between the protrusions and the bottom part of the switch case.

The switch is formed by unifying the rocker-button unit and a push button unit. This structure can provide the small switch having functions of the rocker switch and the push button switch, so that an area for incorporating the switch becomes small. As a result, the switch can be simply incorporated in a dashboard, prevent an erroneous operation by a driver and be promptly operated because the switch has good maneuverability. In addition to that, this switch can provide the click feeling element easily satisfying demands of the market, for example, desired click-feeling or operation, using this structure.

As mentioned above, the bottom part of the push-button unit comes in contact with the upper part of the slider. At the contact section between the push-button unit and the slider, the slider has an arc shape whose center is located on a line connected between rotating shafts of the rocker-button unit. At the contact section, the push-button unit has an arc shape whose diameter is a little larger than a diameter of the arc shape of the slider. In this structure, a lower surface of the arc shape of the push-button unit can fit an upper surface of the arc shape of the slider. As a result, when the rocker-button unit works, smooth operation and good click-feeling can be obtained. In addition to that, this switch can obtain the large contact section easily, so that the slider can move up and down smoothly when the push-button unit is pushed.

The contact section between the push-button unit and the slider can be located at a position above an axis of rotation of the rocker-button unit. When the rocker-button unit moves, an amount of sliding-movement at the contact section between the push-button unit and the slider can be small using this structure. As a result, abrasion resulted from repeated operations of the rocker-button unit can be suppressed, and deterioration of click-feeling can be prevented.

In this switch, an opening section can be formed at a center of the slider, and a light emitting member is located at the substrate. As a result, light can be transmitted to the push-button unit through the opening section, and a surface of the button can be irradiated.

In addition to that, this switch can have a light guide section at the opening section. Light from the light emitting member is gathered using this structure, and a surface of the push-button unit can be irradiated with high efficiency.

First Embodiment

Figure 2:
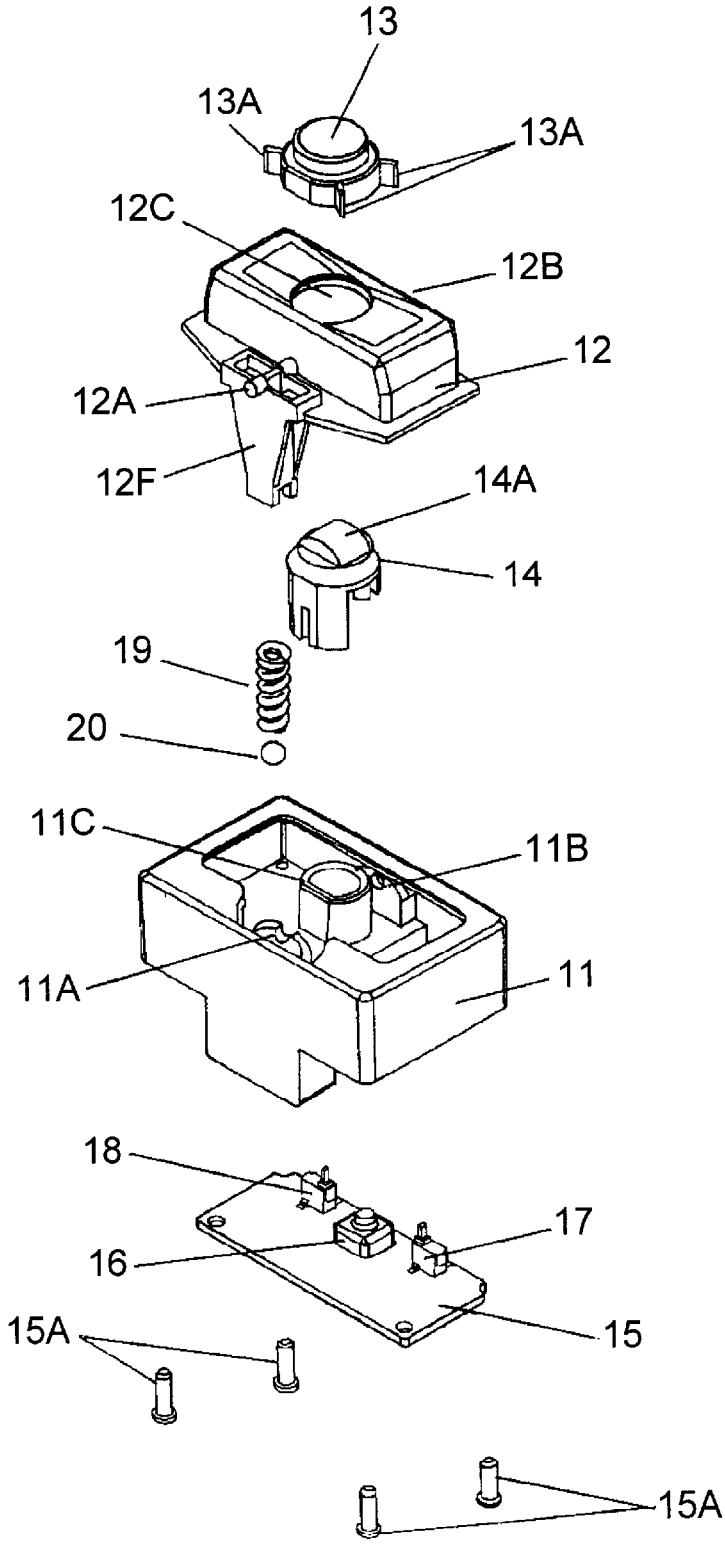
FIG. 2 shows an exploded perspective view of the switch in accordance with the first embodiment of the invention.

FIG. 1 shows a sectional view of a switch in accordance with the first exemplary embodiment of the present invention. FIG. 2 shows an exploded perspective view of the switch in accordance with the first embodiment of the invention. In FIG. 1 and FIG. 2, switch case 11 has openings on its upper surface and lower surface, and an upper surface of rocker-button unit 12, i.e., a rocker switch, protrudes from the opening of the upper surface of switch case 11.

Rotating shafts 12A and 12B, which are formed at a middle of rocker-button unit 12 in the direction of the length and protrude horizontally from unit 12, and are rotatably mated with bearings 11A and 11B, which are formed at upper positions of walls of switch case 11.

Push-button unit 13 is inserted at circular hole 12C of a center of rocker-button unit 12, where an upper section of push-button unit 13, i.e., a pushing switch, is domed. Guide ribs 13A protrude horizontally from a circumference of unit 13, and used for preventing rotation by touching guide sections (not shown) formed at an inner side of rocker-button unit 12. As a result, push-button unit 13 is prevented from rotating.

Semi-cylindrical slider 14, which is held in guide wall 11C incorporated in switch case 11 and is movable vertically, is disposed under push-button unit 13. Upper part 14A of slider 14 comes in contact with bottom part 13B of push-button unit 13, where bottom part 13B has an arc shape.

Figure 3:
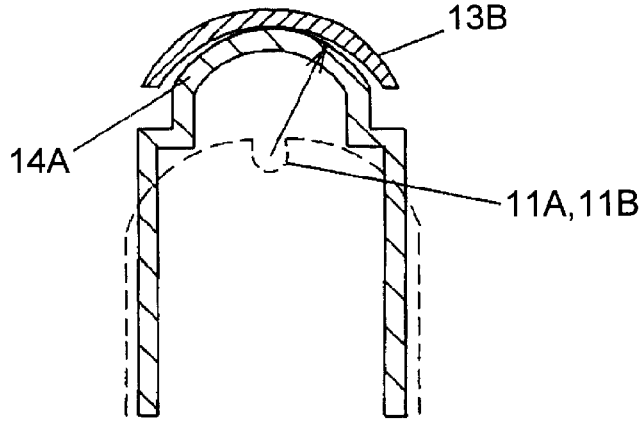
FIG. 3 shows a sectional view of an essential part of the switch in accordance with the first embodiment of the invention.

FIG. 3 shows a sectional view of an essential part of the switch of this invention. As shown in FIG. 3, upper part 14A of slider 14 has an arc shape whose center is located on a line connected between a center of bearing 11A and a center of bearing 11B, which hold rotating shafts 12A and 12B of rocker-button unit 12. Bottom part 13B of push-button unit 13 has the arc shape whose diameter is a little larger than a diameter of the arc shape of upper part 14A of slider 14.

Printed circuit board 15, which is fixed with screws 15A for closing the opening of switch case 11, is disposed under switch case 11. Printed circuit board 15 is used for transmitting ON/OFF signals of switch units 16, 17 and 18, which are disposed on board 15, to an external circuit (not shown).

At switch units 16, 17 and 18, when pushing switches 16A, 17A and 18A are pushed, the switch becomes an ON state, and when pressure for switches 16A, 17A and 18A are removed, the switch returns to an OFF state mechanically by restoring force. At the ON state, an upper part of switch 16A of switch unit 16 comes in contact with bottom part 14B of slider 14, and an upper part of switches 17A, 18A of switch units 17, 18 comes in contact with bottom parts of downward protrusions 12D, 12E. Protrusions 12D and 12E are formed respectively on either side of a line connected between shaft 12A and shaft 12B of rocker-button unit 12.

A click-feeling element is described hereinafter. The click-feeling element is formed of the following elements:

(a) spring 19 formed of a coil spring, (b) ball 20 energised under spring 19, and (c) zigzag section 11D formed on an inner bottom of switch case 11.

Spring 19 and ball 20 are accommodated in cylinder 12F protruded downward from one of the longer side of rocker-button unit 12, and ball 20 comes in contact with zigzag section 11D formed on the inner bottom of switch case 11.

An operation of push-button unit 13 is described hereinafter. In FIG. 1, when push-button unit 13 is pushed, slider 14, which comes in contact with bottom part 13B of push-button unit 13, moves downward along guide wall 11C formed in switch case 11. Then slider 14 pushes pushing switch 16A of switch unit 16, which comes in contact with bottom part 14B of slider 14, and switch unit 16 becomes an ON state. As a result, an ON signal is transmitted to the external circuit via printed circuit board 15.

When pressure for push-button unit 13 is removed, slider 14 moves upward by restoring force of switch unit 16 mechanically, and push-button unit 13 returns to an original state as shown in FIG. 1.

Under the condition that rocker-button unit 12 is operated, when push-button unit 13 is pushed, switch unit 16 can be also an ON state.

When rocker-button unit 12 is pushed (shown at an arrow-mark in FIG. 4), push-button unit 13 is guided in an inner wall of circular hole 12C of rocker-button unit 12, and tilts in the same direction of rocker-button unit 12. Bottom part 13B of push-button unit 13 comes in contact with upper part 14A of slider 14, and unit 13 moves on upper part 14A along the arc whose center is located at the same position of rotating of rocker-button unit 12. As a result, push-button unit 13 does not adversely affect the click-feeling of rocker-button unit 12, and moves smoothly.

Figure 4:
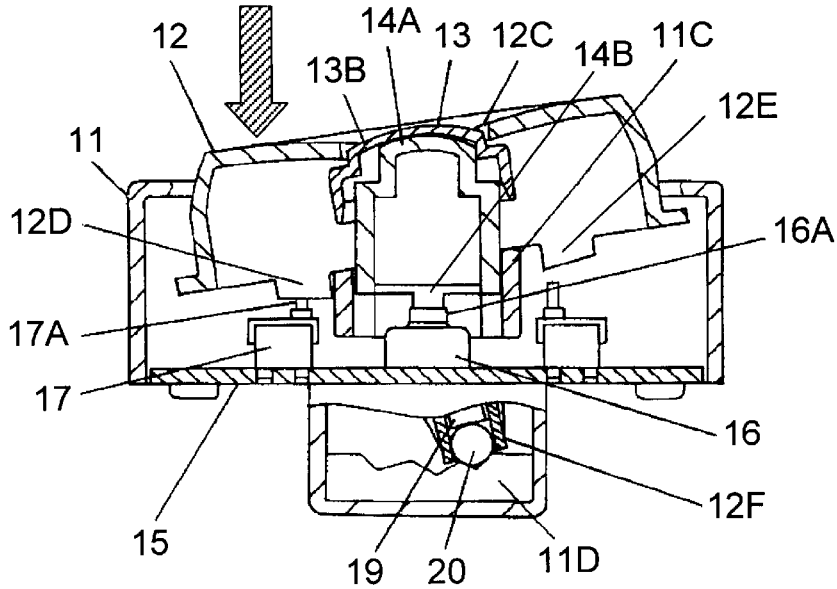
FIG. 4 shows a sectional view of an essential part of the switch in accordance with the first embodiment of the invention.

As shown in FIG. 4, on the condition that rocker-button unit 12 is operated, when push-button unit 13 is pushed, slider 14 moves downward along guide wall 11C, and pushes push switch 16A, so that switch unit 16 becomes an ON state. At that time, though push-button unit 13 is tilted, upper part 14A, which comes in contact with bottom part 13B, and bottom part 13B have arc shapes and can fit each other, so that this structure can obtain a large contact section, and contact condition becomes stable. As a result, pressure to push-button unit 13 is transmitted to slider 14, and slider 14 can be pressed downward and smoothly along guide wall 11C.

In this invention, push-button unit 13 is inserted at circular perforation 12C of the center of rocker-button unit 12, and unit 13 and unit 12 are integrated with each other. Switch units 16, 17 and 18 are worked by operating rocker-button unit 12 and push-button unit 13. This structure can provide the small switch having functions of the rocker switch and the push switch, so that an area for incorporating the switch can be small. As a result, the switch can be simply incorporated in a dashboard, prevent an erroneous operation by a driver and be promptly operated because the switch has good maneuverability.

Push-button unit 13, which has a dome shape, has guide ribs 13A protruded horizontally from a circumference of unit 13, so that guide ribs 13A are regulated by guide sections of rocker-button unit 12. As a result, guide ribs 13A can prevent rotation resulted from repeated operations of push-button unit 13 or vibration of a car, and prevent deterioration of visibility of a display by using push-button unit 13.

The switch of this invention includes ball 20 moving with rocker-button unit 12, spring 19 energising ball 20 and zigzag section 11D of switch case 11. Using the structure mentioned above, this switch can provide the click feeling element satisfying demands of the market, for example, desired click-feeling and an automatic-restoring system whose stop position is only a neutral position.

Second Embodiment

The second embodiment is demonstrated hereinafter. The elements similar to those described in the first embodiment have the same reference marks, and the descriptions of those elements are omitted here.

Figure 5:
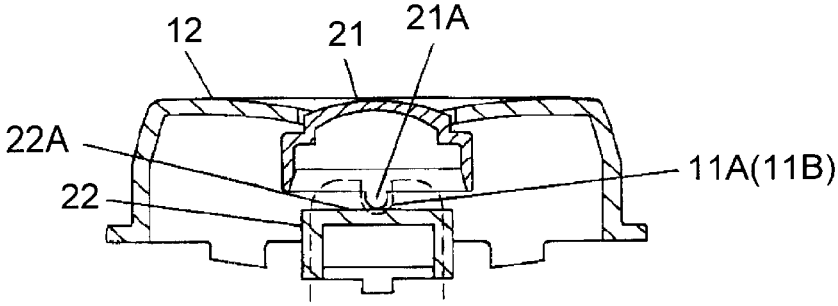
FIG. 5 shows a sectional view of an essential part of a switch in accordance with a second exemplary embodiment of the present invention.

FIG. 5 shows a sectional view of an essential part of a switch in accordance with the second exemplary embodiment of the present invention. Push-button unit 21 has hemispherical fulcrum section 21A protruded downward from its bottom.

A height of fulcrum section 21A of push-button unit 21 is the same as a height of bearings 11A, 11B of switch case 11, namely a height of fulcrum of rocker-button unit 12. The tip of fulcrum section 21A comes in contact with upper surface 22A of slider 22, where upper surface 22A has a plane shape.

An operation of the switch of this invention is described hereinafter.

Figure 6:
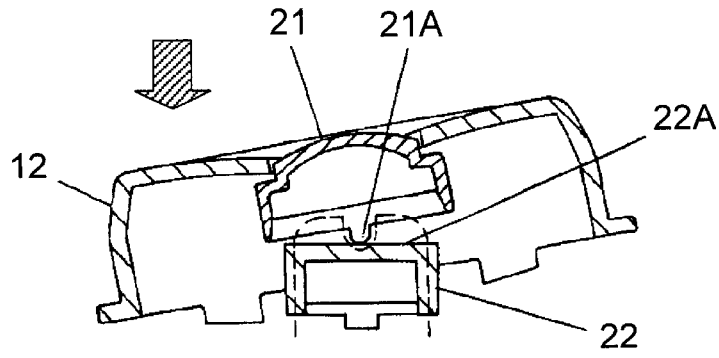
FIG. 6 shows a sectional view of an essential part of the switch in accordance with the second embodiment of the invention.

FIG. 6 shows a sectional view of an essential part of the switch in accordance with the second embodiment of the invention. When a left side of rocker-button unit 12 is pushed (shown at an arrow-mark in FIG. 6), push-button unit 21 is guided in an inner wall of circular hole 12C of rocker-button unit 12, and tilts in the same direction of rocker-button unit 12.

Push-button unit 21 can rotate about fulcrum section 21A, which comes in contact with upper surface 22A of slider 22. At that time, the height of fulcrum section 21A is the same height of fulcrum of rocker-button unit 12. In other words, the position of fulcrum section 21A is located at a position on the line between rotating shafts 12A and 12B. As a result, push-button unit 21 does not adversely affect the click-feeling of rocker-button unit 12, and moves smoothly. In FIG. 6, when push-button unit 21 is pushed, pressure to push-button unit 21 is transmitted to slider 22, so that slider 22 can move smoothly.

According to this invention, an amount of sliding-movement of fulcrum section 21A of push-button unit 21 on upper surface 22A of slider 22 can be small. As a result, abrasion resulted from repeated operations of rocker-button unit 12 can be suppressed, and deterioration of click-feeling can be prevented.

Third Embodiment

The third embodiment is demonstrated hereinafter. The elements similar to those described in the first embodiment or the second embodiment have the same reference marks, and the descriptions of those elements are omitted here.

Figure 7:
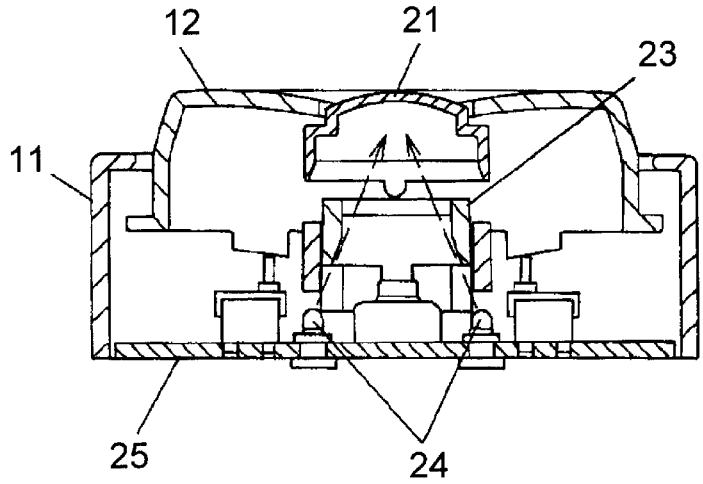
FIG. 7 shows a sectional view of a switch in accordance with a third exemplary embodiment of the present invention.
Figure 8:
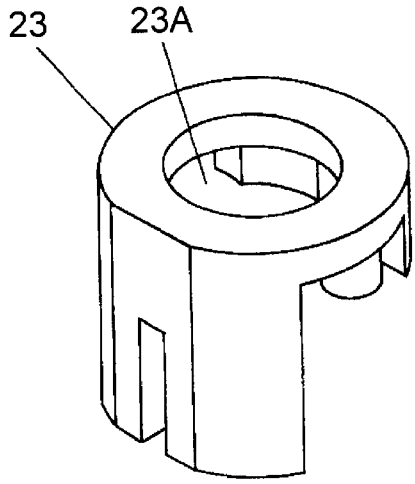
FIG. 8 shows a perspective view of an essential part of the switch in accordance with the third embodiment of the invention.

As shown in FIG. 7, a switch in accordance with the third embodiment of the present invention includes switch case 11, rocker-button unit 12, push-button unit 21 and slider 23. As shown in FIG. 8, opening section 23A is formed on a center of an upper surface of slider 23.

Light emitting diode 24, which is used as a light emitting member, is located at printed circuit board 25, and electric power is supplied from an external circuit to diode 24. Functions for switching of the switch are the same as those described in the first embodiment and the second embodiment.

As shown at broken lines in FIG. 7, using the switch of this invention, light can be guided from light emitting diode 24 to push-button unit 21 via opening section 23A of slider 23. When high light-transmissive material is used as push-button unit 21 and a surface of button 21 is irradiated, high visibility can be obtained even if the switch is located in the darkness.

Figure 9:
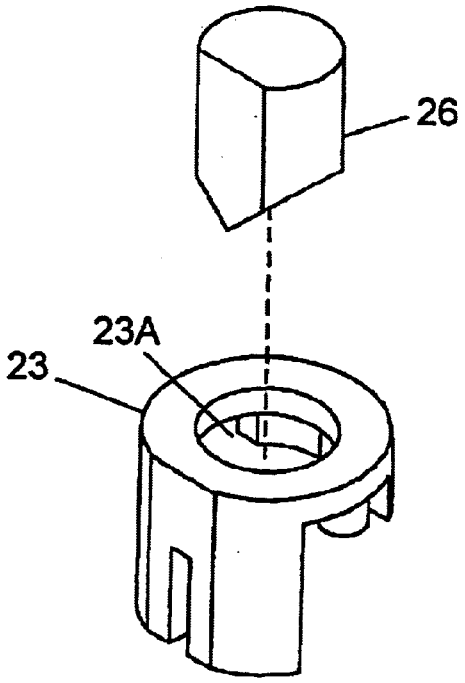
FIG. 9 shows a perspective view of an essential part of the switch in accordance with the third embodiment of the invention.
Figure 10:
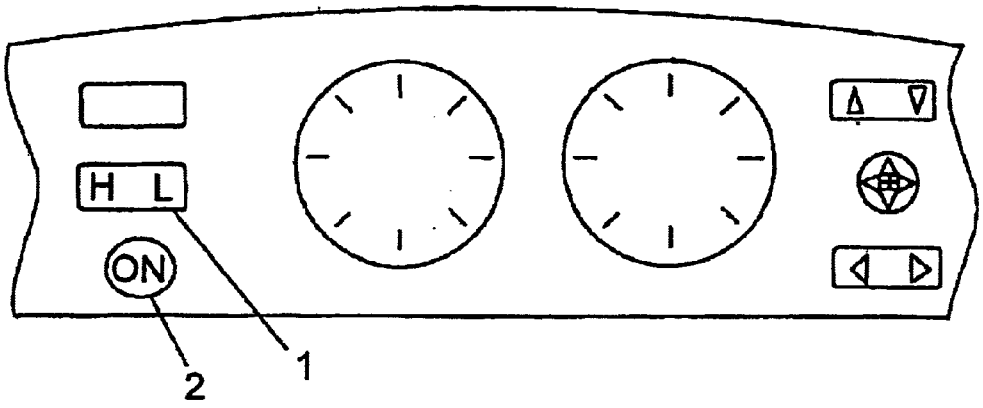
FIG. 10 PRIOR ART
FIG. 10 shows a partial front view of a conventional dashboard.

As shown in FIG. 9, when light guide section 26, which is made of transparent resin and the like, is disposed in opening section 23A of slider 23, light from light emitting diode 24 is gathered, and the surface of the push-button unit 21 can be irradiated with high efficiency.

What is claimed is:

1. A switch comprising:

a switch case;

a rocker-button unit having a hole therein;

a rotatable shaft located at a side of said rocker button unit and held at said switch case;

a push-button unit movably disposed in the hole and having a lower surface; and a slider having an upper surface in contact with said lower surface of said push-button unit, said slider being accommodated in said switch case and being operable to move in a first direction, wherein said rocker-button unit is operable to rotate about said rotatable shaft, and wherein the first direction is independent of a position of said rocker-button unit.

2. A switch comprising:

a switch case;

a rocker-button unit having a hole therein;

a rotatable shaft located at a side of said rocker button unit and held at said switch case;

a push-button unit movably disposed in the hole and having a lower surface; and a slider having an upper surface in contact with said lower surface of said push-button unit, said slider being accommodated in said switch case and being operable to move in a first direction, wherein said lower surface of said push-button unit has a first arc shape, wherein said upper surface of said slider has a second arc shape having a center that is located on an axis of rotation of said rocker-button unit, and wherein a diameter of the first arc shape is larger than a diameter of the second arc shape.

3. The switch of claim 2, wherein said switch case comprises a guide wall, and wherein said slider is held in said guide wall.

4. The switch of claim 2, wherein said push-button unit comprises an upper part having a dome shape.

5. The switch of claim 2, further comprising:

a substrate, which has switch units, disposed under an opening of said switch case, wherein said rocker-button unit has a protrusion, and wherein an upper part of the switch units contact said protrusion and a bottom part of said slider.

6. The switch of claim 2, further comprising a click-feeling element operable to retain a position after an operation of said rocker-button unit.

7. The switch of claim 6, wherein said switch case has an inner bottom, and wherein said click-feeling element includes a zigzag section formed on said inner bottom of said switch case, an elastic member and a head that has an arc shaped lower surface.

8. The switch of claim 7, wherein said rocker-button unit additionally has a cylinder protruding therefrom, wherein said elastic member and said head are accommodated in said cylinder, and wherein said click-feeling element is formed by disposing said head between said zigzag section and said elastic member.

9. The switch of claim 2, wherein said rocker-button unit additionally has a guide section, and wherein a protrusion is disposed at a circumference of said push-button unit and prevents rotation by touching said guide section.

10. The switch of claim 2, further comprising:

a light-emitting member; and a substrate, wherein said push-button unit is light transmissive, wherein an opening section is formed on an upper surface of said slider, wherein said light emitting member is disposed on said substrate, and wherein said light emitting member is operable to irradiate said push-button unit with light.

11. The switch of claim 10, further comprising -a light guide section disposed at the opening section of said slider.

12. A switch comprising:

a switch case;

a rocker-button unit having a hole therein;

a rotatable shaft located at a side of said rocker button unit and held at said switch case;

a push-button unit movably disposed in the hole and having a lower surface; and a slider having an upper surface in contact with said lower surface of said push-button unit, said slider being accommodated in said switch case and being operable to move in a first direction, wherein a hemispherical fulcrum section protrudes from a center of a bottom of said push-button unit, wherein an upper surface of said slider has a plane shape, wherein said fulcrum section contacts the upper surface of said slider, and wherein said push-button unit and said rocker-button unit have the same axis of rotation.

13. The switch of claim 12, wherein said switch case comprises a guide wall, and wherein said slider is held in said guide wall.

14. The switch of claim 12, wherein said push-button unit comprises an upper part having a dome shape.

15. The switch of claim 12, further comprising:

a substrate, which has switch units, disposed under an opening of said switch case, wherein said rocker-button unit has a protrusion, and wherein an upper part of the switch units contact said protrusion of said rocker-button unit and a bottom part of said slider.

16. The switch of claim 12, further comprising a click-feeling element operable to retain a position after an operation of said rocker-button unit.

17. The switch of claim 16, wherein said switch case has an inner bottom, and wherein said click-feeling element includes a zigzag section formed on said inner bottom of said switch case, an elastic member and a head that has an arc shaped lower surface.

18. The switch of claim 17, wherein said rocker-button unit additionally has a cylinder protruding therefrom, wherein said elastic member and said head are accommodated in said cylinder, and wherein said click-feeling element is formed by disposing said head between said zigzag section and said elastic member.

19. The switch of claim 12, wherein said rocker-button unit additionally has a guide section, and wherein a protrusion is disposed at a circumference of said push-button unit and prevents rotation by touching said guide section.

20. The switch of claim 12, further comprising:

a light-emitting member; and a substrate, wherein said push-button unit is light transmissive, wherein an opening section is formed on an upper surface of said slider, wherein said light emitting member is disposed on said substrate, and wherein said light emitting member is operable to irradiate said push-button unit with light.

21. The switch of claim 20, further comprising a light guide section disposed at the opening section of said slider.

* * * * *